US007377319B2

(12) United States Patent
Patterson

(10) Patent No.: US 7,377,319 B2
(45) Date of Patent: May 27, 2008

(54) DOWNHOLE DEVICE TO MEASURE AND RECORD SETTING MOTION OF PACKERS AND METHOD OF SEALING A WELLBORE

(75) Inventor: Daniel L. Patterson, East Tawakoni, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 287 days.

(21) Appl. No.: 11/062,976

(22) Filed: Feb. 22, 2005

(65) Prior Publication Data

US 2006/0185844 A1 Aug. 24, 2006

(51) Int. Cl.
*E21B 33/12* (2006.01)

(52) U.S. Cl. ..... 166/250.17; 166/250.01; 166/387; 166/66; 73/152.59

(58) Field of Classification Search ..... 166/387, 166/250.07, 250.01, 250.17, 66; 73/152.18, 73/152.52, 152.54, 152.55, 152.59
See application file for complete search history.

(56) References Cited

U.S. PATENT DOCUMENTS

| | | | | |
|---|---|---|---|---|
| 3,412,790 | A | 11/1968 | Brown | 166/4 |
| 4,125,013 | A | 11/1978 | Nicolas et al. | 73/151 |
| 4,265,110 | A | 5/1981 | Moulin | 73/151 |
| 4,267,727 | A | 5/1981 | Hoppe | 73/151 |
| 4,269,063 | A | 5/1981 | Escaron et al. | 73/151 |
| 4,409,824 | A | 10/1983 | Salama et al. | 73/151 |
| 4,733,567 | A * | 3/1988 | Serata | 73/784 |
| 4,811,597 | A | 3/1989 | Hebel | 73/151 |
| 5,339,679 | A | 8/1994 | Ingram et al. | 73/84 |
| 5,341,886 | A | 8/1994 | Patton | 175/24 |
| 5,343,963 | A | 9/1994 | Bouldin et al. | 175/27 |
| 5,353,637 | A * | 10/1994 | Plumb et al. | 73/152.17 |
| 5,353,873 | A * | 10/1994 | Cooke, Jr. | 166/64 |
| 5,517,854 | A * | 5/1996 | Plumb et al. | 73/152.59 |
| 5,555,945 | A * | 9/1996 | Schultz et al. | 175/50 |
| 5,730,219 | A | 3/1998 | Tubel et al. | 66/250.01 |
| 5,918,669 | A | 7/1999 | Morris et al. | 166/50 |
| 6,041,860 | A | 3/2000 | Nazzal et al. | 166/250.01 |
| 6,223,821 | B1 * | 5/2001 | Coronado | 166/250.01 |
| 6,662,645 | B2 | 12/2003 | Brewer | 73/152.48 |
| 6,924,745 | B2 * | 8/2005 | Schultz et al. | 340/856.3 |
| 2003/0188862 | A1 | 10/2003 | Streich et al. | 166/250.01 |
| 2004/0045351 | A1 | 3/2004 | Skinner | 73/152.48 |
| 2004/0060696 | A1 * | 4/2004 | Schultz et al. | 166/250.01 |
| 2005/0028972 | A1 * | 2/2005 | Wilson et al. | 166/250.17 |
| 2006/0016593 | A1 * | 1/2006 | Gambier | 166/250.07 |
| 2006/0090892 | A1 * | 5/2006 | Wetzel et al. | 166/250.01 |

OTHER PUBLICATIONS

U.S. Appl. No. 10/116,235, filed Apr. 3, 2002, Streich et al.
U.S. Appl. No. 10/171,025, filed Jun. 13, 2002, Schultz et al.

(Continued)

*Primary Examiner*—Jennifer H Gay
*Assistant Examiner*—Nicole Coy
(74) *Attorney, Agent, or Firm*—John W. Wustenberg; Conley Rose, P.C.

(57) ABSTRACT

A downhole tool assembly including a sealing device and a sensing device for sensing parameters associated with the operation of the sealing device.

18 Claims, 2 Drawing Sheets

OTHER PUBLICATIONS

U.S. Appl. No. 10/251,160, filed Sep. 20, 2002, Schultz et al.
U.S. Appl. No. 10/261,187, filed Sep. 30, 2002, Schultz et al.
U.S. Appl. No. 10/769,121, filed Jan. 30, 2004, Streich et al.
U.S. Appl. No. 10/959,558, filed Oct. 6, 2004, Streich et al.

* cited by examiner

DOWNHOLE DEVICE TO MEASURE AND RECORD SETTING MOTION OF PACKERS AND METHOD OF SEALING A WELLBORE

BACKGROUND

This invention relates to a device and method for use in a downhole oil and gas recovery operation to measure and record the setting motion of packers.

Downhole sealing devices, such as packers, bridge plugs, and the like, are commonly used in many oilfield applications for the purpose of sealing against the flow of fluid to isolate one or more portions of a wellbore for the purposes of testing, treating or producing the well. For example, a packer is usually suspended from a tubing string, or the like, in the wellbore, or in a casing in the wellbore, and includes one or more elastomer elements which are activated, or set, so that the packer elements are forced against the inner surface of the wellbore, or casing, and compressed to seal against the flow of fluid and therefore to permit isolation of certain zones in the well.

When setting sealing devices of this type downhole, a sequence of events occur that generally include the shearing of pins, the movement of components, the compressing of elastomers, the expansion of a slip and the deformation of back-up shoes. It is important to maintain this sequence in a fairly precise manner to obtain a proper set despite the fact that the sequence can be adversely affected by several parameters including bottomhole pressure, bottomhole temperature, stroke time and distance, and external forces.

Also, after a packer has been set, it may move or leak. The cause of the moving or leaking is usually difficult to determine due to a lack of knowledge of the above parameters and other parameters such as the time required to complete the set, the setting force imparted to the packer, etc.

However, it is difficult to measure and quantify these parameters and adjust them as necessary to ensure that the correct sequence is maintained and/or the moving or leaking of the device is eliminated.

Therefore, what is needed is a system that measures, quantifies and records the above parameters to enable the correct sequence to be maintained and/or the cause of any moving or leaking of the sealing device to be determined.

DETAILED DESCRIPTION

Figure 1:
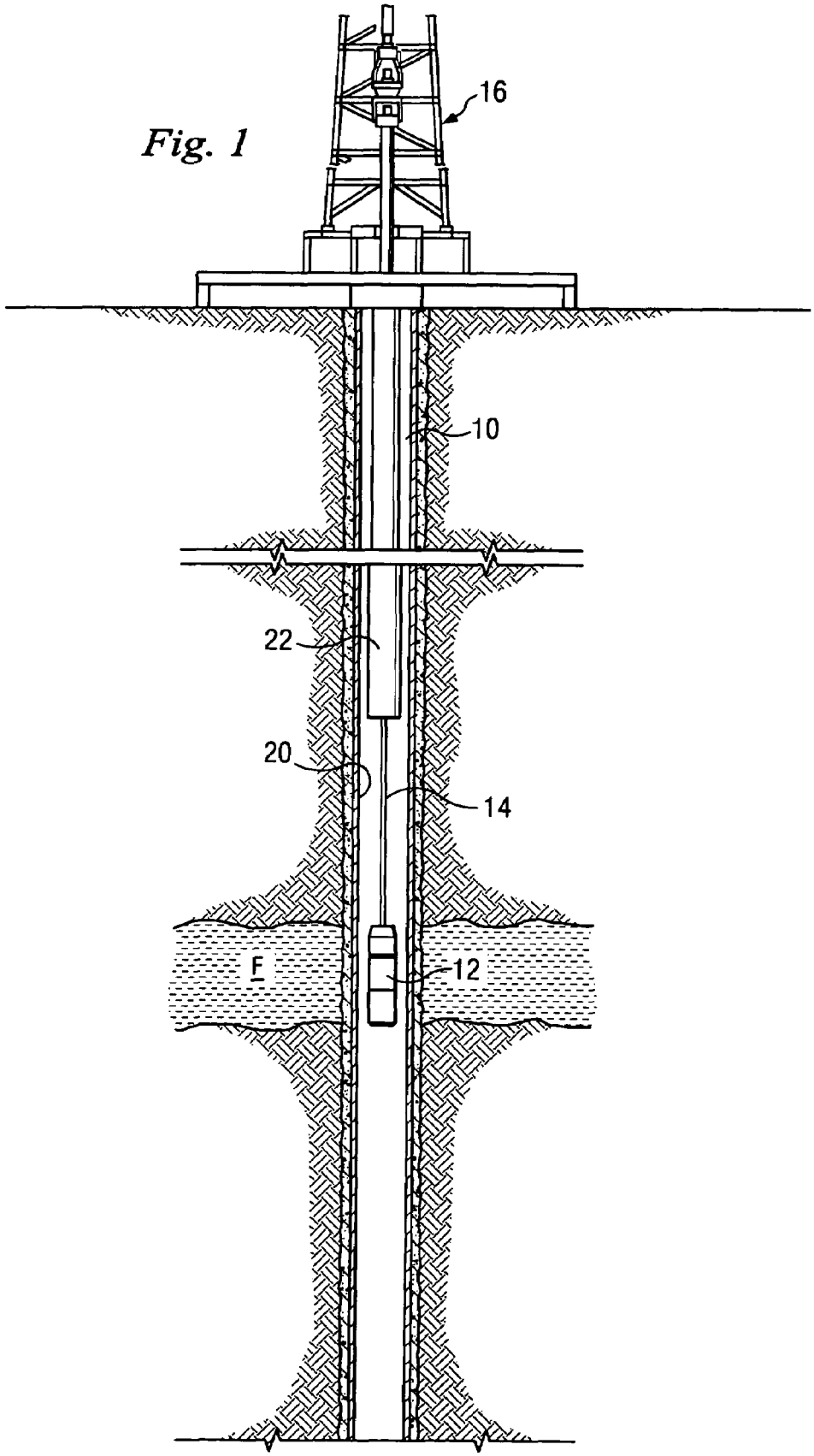
FIG. 1 is a diagrammatic view of an embodiment of the present invention.

Referring to FIG. 1, the reference numeral 10 refers to a wellbore penetrating a subterranean formation F for the purpose of recovering hydrocarbon fluids from the formation F. To this end, a tool assembly 12 is lowered into the wellbore 10 to a predetermined depth by a string 14, in the form of coiled tubing, jointed tubing, wireline, or the like, which is connected to the upper end of the tool assembly 12. The tool assembly 12 is shown generally in FIG. 1 and will be described in detail later.

The string 14 extends from a rig 16 located above ground and extending over the wellbore 10. The rig 16 is conventional and, as such, includes a support structure, a motor driven winch, or the like, and other associated equipment for receiving and supporting the tool assembly 12 and lowering it to a predetermined depth in the wellbore 10 by unwinding the string 14 from the winch.

The wellbore 10 could be an open hole completion or a cased completion utilizing a casing 20 which is cemented in the wellbore 10 in a convention manner. Production tubing 22, having a diameter less than that of the casing 20, can be installed in the wellbore 10 in a conventional manner and extends from the ground surface to a predetermined depth in the casing 20 below the lower end of the casing 20.

Figure 2:
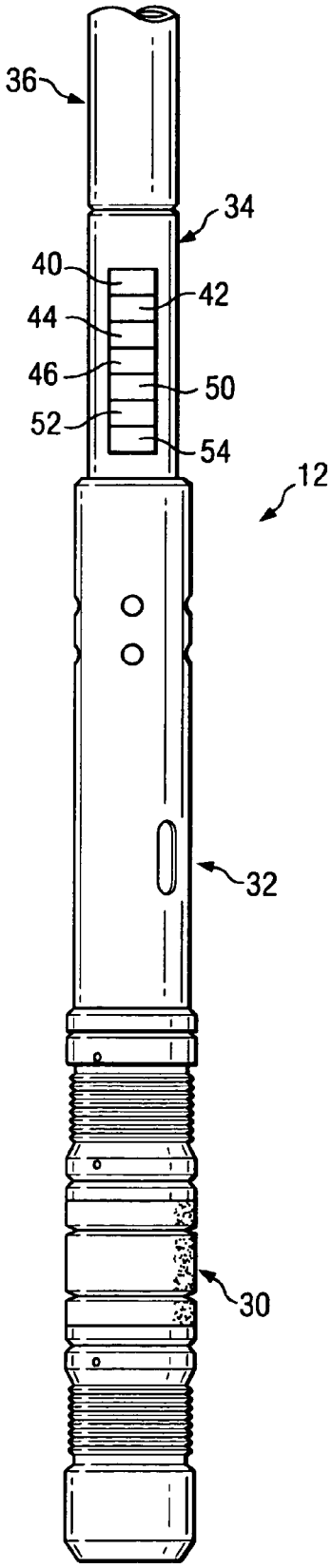
FIG. 2 is a view of a downhole tool according to the embodiment of FIG. 1.
Figure 3:
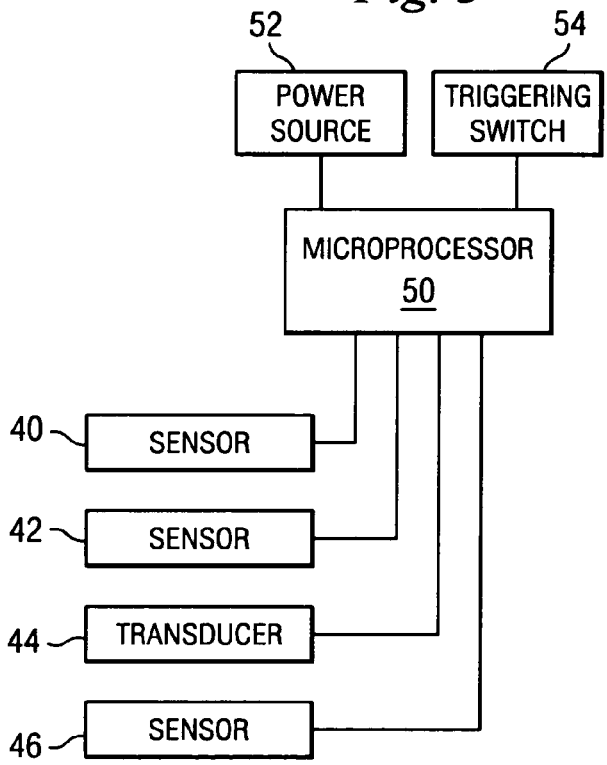
FIG. 3 is a flow chart of a measuring and recording operation of the embodiment of FIG. 1.

With reference to FIGS. 2 and 3, the tool assembly 12 includes a sealing device, which for the purpose of example, is in the form of a packer 30. Since the packer 30 is conventional, it will not be described in detail.

The lower end of a tubular setting adapter 32 is connected to the upper end of the packer 30 in any conventional manner, and the upper end of the tubular setting adapter 32 is connected to the lower end of a sensing device 34 that will be described in detail. A setting tool 36 for setting the packer 30 is connected between the sensing device 34 and the string 14 (FIG. 1), and is shown partially. Since the tubular setting adapter 32 and the setting tool 36 are also conventional, they will not be described in detail.

The sensing device 34 includes instrumentation for electronically sensing several parameters, or conditions involving the packer 30 during its movement into sealing engagement with the inner wall of the casing 20 after being actuated by the setting tool 36. In particular, this instrumentation could be in the form of a sensor 40, such as the type marketed by Duncan Electronics of Commerce, Tex., as model 710-552-0-0. The sensor 40 senses displacement of the packer 30 as it moves radially outwardly towards its set, or sealing engagement. A sensor 42, such as model LC702-100k, marketed by the Omega Engineering, Inc. of Stamford, Conn., senses tensile and/or compressive loads on the packer 30 during and after the set is completed, such as by using a load cell tension link.

The sensing device 34 includes additional instrumentation for electronically sensing fluid pressure and temperature in the wellbore 10 at or near the packer 30. In particular, this instrumentation could be in the form of a transducer 44, such as model 211-32-9200 marketed by Paine Electronics LLC of Seattle, Wash., that senses the fluid pressure. A sensor 46 could be in the form of any conventional temperature sensor, such as the Smart Sensor, model. 1250-RP-0-L-1/2-S-12-MT-1.

All sensed data from the sensors 40, 42, and 46, and the transducer 44 are transmitted to a microprocessor 50, such as model INC-TP1, marketed by the Numar Corporation of Malvern, Pa., for recording the data. A plurality of electrical conductors (not shown) could be provided to electrically connect the sensors 40, 42, and 46, and the transducer 44 to the microprocessor 50, or the transmissions could be made by wireless connections. The microprocessor 50 could also be provided with software to enable a diagnostic check to be provided.

A power source 52, such as a battery capable of supplying a sufficiently high DC voltage, is also provided on or in the sensing device 34 along with a triggering switch 54 designed to stop the above sensing and recording when the above stroke ends or after a predetermined time period after the packer 30 is set. Although the power source 52 and the triggering switch 54 are shown in FIG. 3 as being connected to the microprocessor 50 for distribution of the power to the sensors 40, 42, and 46, and the transducer 44, it is understood that they also could be directly connected to these components.

It is understood that the sensors 40, 42, and 46, the transducer 44, the microprocessor 50, the power source 52, and the triggering switch 54 are all mounted on or in the sensing device 34 in a conventional manner. Alternately, the sensing device 34 could contain the proper electronics to permit the above-described sensing and measuring functions without having the separate sensors 40, 42, and 46, and the transducer 44. Also, additional electronics, such as interface bridge circuits, voltage and switching regulators, sensor interface boards, power supplies and the like, can also be provided as needed to enable the operations described below to be performed. Since these electronics are conventional they will not be described in further detail.

In operation, the microprocessor 50 initially performs a conventional diagnostic check just prior to running the tool assembly 12 in the wellbore 10 (FIG. 1) to verify that all systems are functioning. As the tool assembly 12 is lowered into the wellbore 10, the transducer 44 senses the fluid pressure, the sensor 46 senses wellbore temperature and the sensor 42 senses the tensile and compressive loads on the packer 30.

Once the packer 30 is at the proper setting depth, the setting tool 36 is activated in a conventional manner and, as it starts to stroke, it causes a corresponding displacement of the elements of the packer 30 radially outwardly until they reach the set position of the packer 30 in which they sealingly engage the inner wall of the casing 20. During this movement, the sensor 40 senses the displacement of the packer 30, and the sensor 42 continues to sense the loads on the packer 30. Also, the transducer 44 and the sensor 46 continue to sense the fluid pressure and the temperature, respectively, at or near the packer 30.

The above sensing by the sensors 40, 42, and 46, and the transducer 44 could be done at certain predetermined sampling rates which may vary according to the design, and the sensed data transmitted to the microprocessor 50 for recording and storing the data. A microswitch, or the like (not shown) could be provided to start the sensing and recording of the displacement data from the sensor 40. The triggering switch 54 stops all of the above sensing and recording functions when the above stroke ends or after a predetermined time period after the packer 30 is set.

The tool assembly 12 is then raised to the surface where the service personnel at the rig 16 could download the data from the microprocessor 50 to a laptop computer or the like, via an ethernet connection, or the like, which would perform an immediate analysis. In this context, when the temperature ratings of the packer 30, the required setting stroke for a given ID of the casing 20, and the required force to fully set the packer 30, are available, the measured and recorded data could be used to determine if the proper forces on, and setting strokes of, the packer 30 are achieved. Thus, any potential problems in connection with the setting of the packer could be determined in advance of any related real problems.

Also, this data could be used to determine any defects in the packer 30 manifested by overstroking (due to the wrong casing size or damaged casing), stroking too quickly (due to defective setting tools), or downhole temperatures exceeding the packer's 30 rating. Further, the force versus stroke (displacement) curve should provide insight into how the elements of the packer 30 deploy under various downhole conditions.

A database of the above parameters can be established for various packers at various well conditions and the database could form a basis for design improvements. This data could also result in typical setting curves to compare actual jobs to further detect abnormal packer setting operations.

It is understood that variations may be made in the foregoing without departing from the scope of the invention. For example, the above embodiment is not limited to use with packers but is equally applicable to other sealing devices such as bridge plugs, and the like. Also, the number and type of sensors and measuring devices discussed above can be varied. Further, spatial references, such as "upward", "downward", "vertical", etc. are for the purpose of illustration only and do not limit the specific orientation or location of the structure described above.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A tool assembly for use in a wellbore, comprising:

a sealing device;

an actuating device adapted to actuate the sealing device to cause movement of the sealing device to a sealing position;

a sensing device for sensing at least one condition of the sealing device during the movement and producing a corresponding output; and a microprocessor for processing the output;

wherein the condition is displacement of the sealing device, and wherein the sensing device also senses temperature in the wellbore at or near the sealing device.

2. The assembly of claim 1 wherein the sensing device also senses fluid pressure in the wellbore at or near the sealing device.

3. The assembly of claim 1 wherein the sealing device, the sensing device, and the actuating device are connected to form a tool string.

4. The assembly of claim 1 wherein the sealing device is a packer.

5. The assembly of claim 1 wherein displacement comprises radial movement of the sealing device outward.

6. A tool assembly for use in a wellbore, comprising:

a sealing device;

an actuating device adapted to actuate the sealing device to cause movement of the sealing device to a sealing position;

a sensing device for sensing at least one condition of the sealing device during the movement and producing a corresponding output; and a microprocessor for processing the output;

wherein the condition is displacement of the sealing device, and wherein the microprocessor compares data to known data to determine if the sealing device is functioning properly.

7. A method of sealing in a wellbore, comprising:

actuating a sealing device to cause movement of the sealing device to a sealing position;

sensing at least one condition of the sealing device during the movement and producing a corresponding output; and comparing the output to known data to determine if the sealing device is functioning properly;

wherein the condition is displacement of the sealing device.

8. The method of claim 7 wherein a second condition is tensile and/or compressive loads on the sealing device.

9. The method of claim 7 further comprising sensing fluid pressure in the wellbore at or near the sealing device.

10. The method of claim 7 further comprising sensing temperature in the wellbore.

11. The method of claim 7 wherein displacement comprises stroke distance.

12. The method of claim 7 wherein displacement comprises radial movement of the sealing device outward.

13. A tool assembly for use in a wellbore, comprising:

a sealing device;

an actuating device adapted to actuate the sealing device to cause movement of the sealing device to a sealing position;

a sensing device for sensing at least one condition of the sealing device during the movement and producing a corresponding output; and a microprocessor for processing the output;

wherein the condition is displacement of the sealing device, and wherein a second condition sensed is tensile and/or compressive loads on the sealing device.

14. A tool assembly for use in a wellbore, comprising:

a sealing device;

an actuating device adapted to actuate the sealing device to cause movement of the sealing device to a sealing position;

a sensing device for sensing at least one condition of the sealing device during the movement and producing a corresponding output;

a microprocessor for processing the output; and a second sensing device for sensing tensile and/or compressive loads on the sealing device and producing a second corresponding output, wherein the condition is displacement of the sealing device.

15. A tool assembly for use in a wellbore, comprising:

a sealing device;

an actuating device adapted to actuate the sealing device to cause movement of the sealing device to a sealing position;

a sensing device for sensing at least one condition of the sealing device during the movement and producing a corresponding output; and a microprocessor for processing the output;

wherein the condition is displacement of the sealing device, and wherein the microprocessor compares the output regarding displacement of the sealing device to a known set position for the sealing device within the wellbore's inner diameter.

16. A tool assembly for use in a wellbore, comprising:

a sealing device;

an actuating device adapted to actuate the sealing device to cause movement of the sealing device to a sealing position;

a sensing device for sensing at least one condition of the sealing device during the movement and producing a corresponding output; and a microprocessor for processing the output;

wherein:

a first condition sensed is displacement of the sealing device with a corresponding output;

a second condition sensed is tensile and/or compressive loads on the sealing device with a corresponding output;

the microprocessor compares the output regarding displacement of the sealing device to a known set position for the sealing device within the wellbore's inner diameter; and the microprocessor compares the output regarding tensile and/or compressive loads on the sealing device to a known force for fully setting the sealing device.

17. A method of sealing in a wellbore, comprising:

actuating a sealing device to cause movement of the sealing device to a sealing position;

sensing at least one condition of the sealing device during the movement and producing a corresponding output; and comparing the output to known data to determine if the sealing device is functioning properly;

wherein:

a first condition sensed is displacement of the sealing device with a corresponding output;

a second condition sensed is tensile and/or compressive loads on the sealing device with a corresponding output;

the output regarding displacement of the sealing device is compared to a known set position for the sealing device within the wellbore's inner diameter; and the output regarding tensile and/or compressive loads on the sealing device is compared to a known force for fully setting the sealing device.

18. A tool assembly for use in a wellbore, comprising:

a sealing device;

an actuating device adapted to actuate the sealing device to cause movement of the sealing device to a sealing position;

a sensing device for sensing at least one condition of the sealing device during the movement and producing a corresponding output; and a microprocessor for processing the output;

wherein the condition is displacement of the scaling device, and wherein displacement comprises stroke distance.

* * * * *